United States Patent [19]

Parque

[11] Patent Number: 4,561,642

[45] Date of Patent: Dec. 31, 1985

[54] PORTABLE VACUUM HOLDING DEVICE

[76] Inventor: John P. Parque, 3801 Abbott Rd., Lynwood, Calif. 90262

[21] Appl. No.: 590,450

[22] Filed: Mar. 16, 1984

[51] Int. Cl.[4] ..... B25B 11/00

[52] U.S. Cl. ..... 269/21; 269/95

[58] Field of Search ..... 269/21, 95; 51/235; 279/3; 294/64.1; 285/7, 158

[56] References Cited

U.S. PATENT DOCUMENTS

| | | | |
|---|---|---|---|
| 1,851,028 | 3/1932 | Worrall . | |
| 2,457,908 | 1/1949 | Meyerhoeffer | 285/7 |
| 2,782,574 | 2/1957 | Copold | 51/235 |
| 3,520,055 | 7/1970 | Jannett | 269/21 |
| 3,584,859 | 6/1971 | Siron | 269/21 |
| 3,652,075 | 3/1972 | Thompson | 269/21 |
| 4,138,080 | 2/1979 | Albert | 269/21 |
| 4,313,478 | 2/1982 | Suzuki | 144/1 A |

*Primary Examiner*—Frederick R. Schmidt
*Assistant Examiner*—Judy J. Hartman
*Attorney, Agent, or Firm*—John T. Matlago

[57] ABSTRACT

A portable vacuum holding device is provided for holding a planar wood workpiece in an elevated position above the flat surface of a workbench so that the workpiece can be conveniently worked upon. The device comprises a plastic molded thin-walled hollow body having four sidewalls with an inwardly rim extending about the upper ends thereof defining a rectangular top opening and an outwardly rim extending about the lower ends thereof defining a rectangular bottom opening. A plastic molded thin-walled sleeve is positioned within a circular opening provided on one of the sidewalls of the hollow body with its shoulder secured by an adhesive to provide an airtight seal. Flat sponge-rubber gaskets are provided on the top and bottom rims. The end connector of a flexible hose provided on a portable vacuum pump is adapted to fit within the sleeve with an airtight fit. When the hollow body is positioned on the flat surface of a workbench and a planar wood workpiece is placed over the top opening thereof, an enclosed chamber is formed which when evacuated by the vacuum pump provides for holding the workpiece on the top rim of the hollow body and for holding the bottom rim of the hollow body against the flat surface of the workbench.

2 Claims, 7 Drawing Figures

PORTABLE VACUUM HOLDING DEVICE

BACKGROUND OF THE INVENTION

This invention relates to vacuum holders and more particularly to a portable vacuum holding device for use in holding planar workpieces on a workbench.

When a home worker desires to perform operations on a planar workpiece such as a flat piece of wood, for example, it is the common practice to use a vise permanently mounted on a workbench to hold the workpiece while performing the operations thereon. The holding of a wood workpiece in this manner may be undesirable at times because the jaws of the vise tend to mar the surface thereof. Moreover, a vise large enough to be used for this purpose represents a relatively large investment for a device that is not being used at all times.

In view of the foregoing, a need clearly exists for a vacuum holding device for use by the homeworker which is portable, that can easily be made available for use when needed, and which is inexpensive.

It is, therefore, an object of the present invention to provide a portable vacuum holding device especially adapted for securely anchoring a planar wood workpiece on a workbench.

Another object of the present invention is to provide a simple and inexpensive light weight vacuum holding device for use in conveniently holding a planar workpiece in an elevated position above the surface of a workbench so that various operations can be readily performed thereon.

Another object of the present invention is to provide a vacuum holding device for use in positively anchoring a flat wood workpiece relative to the flat surface of a workbench wherein a connector on the end of a flexible hose provided on a portable vacuum pump of the type normally provided in the home for a canister vacuum cleaner is adapted to be quickly connected thereto to provide the vacuum needed for its operation.

BRIEF DESCRIPTION OF THE PRESENT INVENTION

In accordance with the present invention, a portable vacuum holding device comprises a molded four-sided thin-walled upright hollow body. The hollow body has an inwardly extending rim formed about the rectangular opening provided at the top thereof and an outwardly extending rim formed about the rectangular opening provided at the bottom thereof. A top flat sponge-rubber gasket is seured on the inwardly extending top rim and a similar bottom flat sponge-rubber gasket is secured on the outwardly extending bottom rim. The hollow body is molded with a circular opening on one of the sidewalls thereof. A molded sleeve having a conical thin-walled portion with a shoulder on the larger diameter end thereof is inserted in the circular opening on the sidewall of the upright hollow body with its shoulder held by an adhesive on the surface of the sidewall surrounding the circular opening to provide an airtight seal. A connector on the end of a flexible hose as provided for a portable vacuum pump of the type normally used in the home for operating a canister vacuum cleaner is adapted to have a quick airtight connection within the sleeve and also a quick disconnection therefrom.

When it is desired to use the portable vacuum holding device, the light weight molded upright hollow body is placed on the flat surface of a workbench to close off the bottom opening thereof. The planar wood workpiece is then placed on the top of the upright hollow body to cover the top opening thereof. The connector on the end of the flexible hose of the vacuum pump is then seated within the sleeve on the sidewall of the hollow body and the vacuum pump is turned on by use of a switch.

These and other objects, features and advantages of the present invention will be made more readily apparent from the following detailed description of the preferred embodiment as illustrated in the accompanying drawings.

DRAWING SUMMARY

PREFERRED EMBODIMENT

Figures 1, 2, 3, 4, 5, 6, 7:
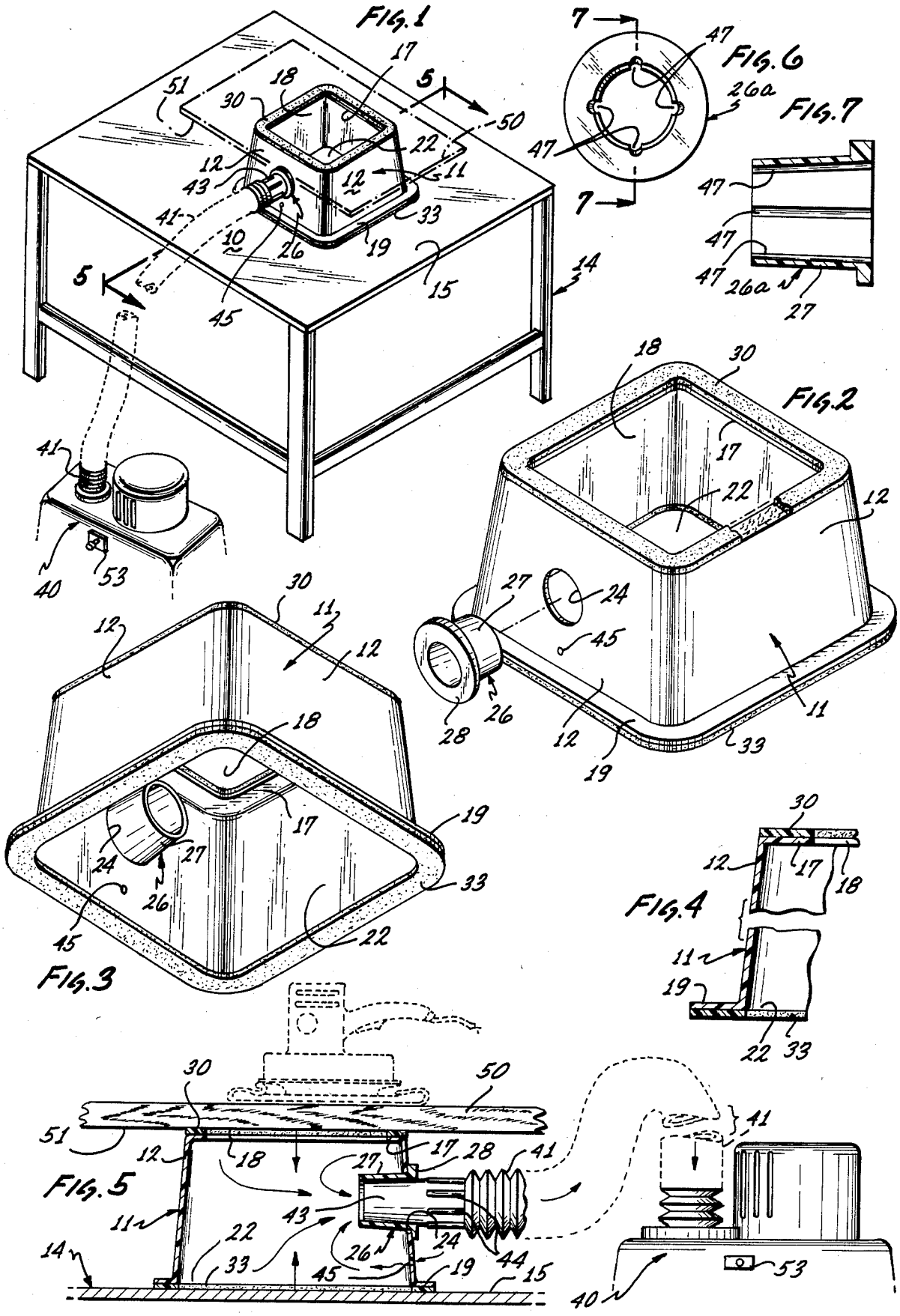
FIG. 1 is a perspective view showing the vacuum holding device of the present invention being used to hold a planar wood workpiece on a workbench.
FIG. 2 is a perspective view of the vacuum holding device as viewed from the top thereof with the sleeve exploded away from the sidewall thereof.
FIG. 3 is a perspective view of the vacuum holding device as viewed from the bottom thereof.
FIG. 4 is a sectional view of a sidewall of the hollow body showing the gaskets on the top and bottom rims thereof.
FIG. 5 is an enlarged sectional view through the vacuum holding device as taken on line 5—5 of FIG. 1 showing it mounted on the surface of a woodbench with a flat wood workpiece positioned on the top rim thereof and the end connector of the flexible hose of the vacuum pump fitted in the sleeve provided on the sidewall thereof.
FIG. 6 is a modified structure for the sleeve.
FIG. 7 is a sectional view of the sleeve as taken on line 7—7 of FIG. 6.

Referring to the drawings, the vacuum holding device 10 of the present invention includes an upright hollow body 11 which may be molded of a stiff plastic to have four thin sidewalls 12. The four sidewalls 12 of the housing 11 tilt inwardly at the upper ends thereof to provide a rigid support structure. An inwardly extending flat relative-short thin rim 17 is molded about the upper edges of all four sidewalls 12 so as to define a square large top opening 18 and an outwardly extending flat relatively-short thin rim 19 is molded about the lower edges of all four sidewalls 12 so as to define a square large bottom opening 22.

A circular opening 24 is molded on one of the sidewalls 12. A sleeve 26 molded of the same stiff plastic used for the hollow body 11 is provided with a slightly conically shaped thin-walled portion 27 having a shoulder 28 on the larger diameter end thereof. The undersurface of the shoulder 28 is shaped so that when the conical portion 27 of the sleeve 26 is inserted into the circular opening 24, the undersurface of shoulder 28 contacts the edges of the circular opening 24 while positioning the conical portion 27 so that its axis is preferably parallel to the top and bottom rims 17 and 19. An adhesive is used for cementing the underside surface of shoulder 28 with an airtight fit about the edges of the circular opening 24.

A top sponge-rubber flat gasket 30 is secured by an adhesive over the inwardly extending rim 17 on the top of the hollow body 11 and a bottom sponge-rubber flat gasket 33 is similarly secured over the outwardly extending rim 19 on the bottom of the hollow body 11. It should be appreciated that the hollow body 11 of the vacuum holding device 10 is a very light-weight molded structure.

A portable vacuum pump 40 for use with the hollow body 11 includes a flexible hose 41 having a slightly conical plastic connector 43 on the end thereof. The conical sleeve 26 on the sidewall 12 of the hollow body 11 is adapted to receive the conical end connector 43 with an airtight fit while at the same time enabling the conical connector 43 to be quickly detached by simply twisting it slightly by use of the spaced longitudinal proturbances 44 provided on the base end thereof. The vacuum pump 40 can thus be conveniently and rapidly connected to or disconnected from the hollow body 11. It should be noted that the portable vacuum pump 40 may be the type conventionally provided in a home for operating a cannister vacuum cleaner. Thus, when one already has such a vacuum cleaner in the home it is only necessary to purchase the hollow body 11 with the sleeve 26 thereon, thus greatly reducing the cost of providing the vacuum holding device 10.

Inasmuch as the portable vacuum cleaner pump 40 depends on a continual intake of air to keep its parts cool, a small bleeder hole 45 may be provided on one of the sidewalls 12, as shown in FIG. 5, to permit a controlled amount of air to continually feed into the hollow body 11 and be withdrawn by the vacuum pump 40. As shown in FIGS. 6 and 7, in an alternate arrangement, the inner wall of a sleeve **26*a* may be provided with angularly spaced longitudinal flutes 47. Thus, when the end connector 43 on the flexible hose 41 of the vacuum pump 40 is inserted into the sleeve 26*a*, the flutes 47 permit a controlled amount of air to enter the hollow body 11 and be withdrawn by the vacuum pump 40 while the latter is operating to draw a vacuum to hold the workpiece 50 on the workbench 14**.

When a homemaker decides that he wants to do some work on a planar workpiece made of wood, such as workpiece 50, he takes the light weight hollow body 11 and places its gasket cover bottom rim 19 on the flat surface 15 of a workbench 14. He then positions the planar wood workpiece 50 to be operated upon on the gasket covered top rim 17 of the hollow body 11 so as to cover the top opening 18 thereof. The top and bottom gaskets 30 and 33, respectively, ensure an airtight fit. The connector 43 on the end of flexible hose 41 is then pushed into the opening of the sleeve 26 to provide an airtight connection.

It should now be clearly understood that when so positioned the interior of hollow body 11 forms a closed chamber in that the flat top surface 15 of the workbench 14 closes off the large bottom opening 22 thereof and the bottom flat surface 51 of the planar workpiece 50 closes off the large top opening 18 thereof. As a result, when the vacuum pump 40 is turned on by closing the switch 53 on the vacuum pump 40, the vacuum created within the chamber of the hollow body 11 is exerted on the planar workpiece thus developing the holding force that causes it to be anchored on the gasket covered top rim 17 of the hollow body 11 and also causes the hollow body 11 to be anchored onto the top flat surface 15 of the workbench 14. It should now be clearly understood that the vacuum within the hollow body not only serves to create a force to hold the planar workpiece on the gasket covered top rim 17 of the hollow body 11 but also to hold the gasket covered bottom rim 19 of the hollow body on the surface 15 of the workbench 14. Both the workpiece 50 and the hollow body 11 are thus held against shifting or displacement with respect to the surface 15 of the workbench 14.

Such a vacuum holding device 10 thus holds the planar workpiece 50 at a convenient elevated position above the surface of the workbench 14 so that its entire upper surface and edges are all fully exposed, thus permitting operations such as sanding, drilling of holes, or sawing to be performed thereon. In order to break the suction so as to release the workpiece 50 and the hollow body 11, the vacuum pump 40 may be turned off by use of switch 53 or the end connector 43 of the flexible hose 41 may be twisted out of the sleeve 27.

While the preferred embodiment of the vacuum holding device as described herein is well adapted to fulfill the objects and advantages previously mentioned as desirable, it is to be understood that the invention is not limited to the specific features shown and described but that the means and configuration herein disclosed are susceptible of modification in form, proportion, and arrangement of parts without departing from the principles involved or sacrificing any of its advantages, and the invention is, therefore, claimed in embodiments of various forms all coming within the scope of the claims which follow.

What is claimed is:

1. A portable vacuum holding device for use in holding a planar wood workpiece in an elevated position above the flat surface of a workbench so that the workpiece can be operated upon, said device comprising:

a molded, rigid, upright, hollow body formed with four thin sidewalls tilting inwardly toward the top thereof, one of said sidewalls having a bleeder hole therein;

said hollow body further provided with an internally extending flat rim about the top of the four sidewalls thereof defining a top rectangular opening and with an externally extending flat rim about the bottom of the four sidewalls thereof defining a bottom rectangular opening;

a flat sponge-rubber gasket secured on said top rim and a similar gasket secured on said bottom rim;

a molded sleeve including a thin-walled conically shaped portion provided on a larger diameter end thereof with a shoulder having an undersurface;

said conically shaped portion of said sleeve being positioned in a circular opening provided on one of the sidewalls of said hollow body with the undersurface of said shoulder adapted to contact and be secured about the edge of said circular opening, said conically shaped portion of said sleeve adapted to seat therein a conically shaped connector on an end of a flexible hose of a portable vacuum pump to provide a quick connect and disconnect thereto;

whereby when said upright hollow body is positioned with its gasket covered bottom rim resting on the flat surface of a workbench and a planar wood workpiece is placed on the gasket covered top rim of said hollow body to cover the top opening thereof, withdrawing of air by said vacuum pump from the enclosed chamber so formed causes said workpiece to be anchored to the top of said hollow body and the bottom of said hollow body to be anchored to the surface of said workbench while said bleeder hole permits a controlled amount of air to enter the hollow body.

2. A portable vacuum holding device for use in holding a planar wood workpiece in an elevated position above the flat surface of a workbench so that the workpiece can be operated upon, said device comprising:

a molded, rigid, upright, hollow body formed with four thin sidewalls tilting inwardly toward the top thereof;

said hollow body further provided with an internally extending flat rim about the top of the four sidewalls thereof defining a top rectangular opening and with an externally extending flat rim about the bottom of the four sidewalls thereof defining a bottom rectangular opening;

a flat sponge-rubber gasket secured on said top rim and a similar gasket secured on said bottom rim;

a molded sleeve including a thin-walld conically shaped portion provided on a larger diameter end thereof with a shoulder having an undersurface, said sleeve being provided with a plurality of spaced longitudinal grooves on the inner surface thereof;

said conically shaped portion of said sleeve being positioned in a circular opening provided on one of the sidewalls of said hollow body with the undersurface of said shoulder adapted to contact and be secured about the edge of said circular opening, said conically shaped portion of said sleeve adapted to seat therein a conically shaped connector on an end of a flexible hose of a portable vacuum pump to provide a quick connect and disconnect thereto;

whereby when said upright hollow body is positioned with its gasket covered bottom rim resting on the flat surface of a workbench and a planar wood workpiece is placed on the gasket covered top rim of said hollow body to cover the top opening thereof, withdrawing of air by said vacuum pump from the enclosed chamber so formed causes said workpiece to be anchored to the top of said hollow body and the bottom of said hollow body to be anchored to the surface of said workbench while said spaced longitudinal grooves on the inner surface of said sleeve permit a controlled amount of air to enter the hollow body.

* * * * *